United States Patent [19]

Suzuki

[11] 4,089,378

[45] May 16, 1978

[54] COPY PAPER EXHAUSTING ROLLER UNIT FOR USE IN ELECTROPHOTOGRAPHIC COPYING MACHINE

[75] Inventor: Katsuo Suzuki, Tokyo, Japan

[73] Assignee: Fuji Xerox Co., Ltd., Tokyo, Japan

[21] Appl. No.: 328,697

[22] Filed: Feb. 1, 1973

[30] Foreign Application Priority Data

Feb. 3, 1972 Japan ..... 47-13677[U]

[51] Int. Cl.[2] ..... A62C 1/00; G03G 15/00

[52] U.S. Cl. ..... 169/54; 271/80; 271/272; 355/3 R

[58] Field of Search ..... 355/64, 65, 3, 10, 11, 355/66; 169/54; 271/80, 188, 198, 199, 202, 203, 272–274; 226/190, 192; 29/121 A

[56] References Cited

U.S. PATENT DOCUMENTS

| | | | |
|---|---|---|---|
| 2,606,478 | 8/1952 | Pratt | 355/65 |
| 3,124,996 | 3/1964 | Pfaff | 355/65 |
| 3,507,333 | 4/1970 | Quant et al. | 169/54 X |

FOREIGN PATENT DOCUMENTS

| | | | |
|---|---|---|---|
| 22,460 of | 1911 | United Kingdom | 271/272 |

OTHER PUBLICATIONS

G. T. Williams, Fire Snuffer, IBM Technical Disclosure Bulletin, vol. 12,No. 12, May 1970, p. 2307.

*Primary Examiner*—Evon C. Blunk
*Assistant Examiner*—Andres Kashnikow
*Attorney, Agent, or Firm*—Gerald J. Ferguson, Jr.; Joseph J. Baker

[57] ABSTRACT

A roller unit for removing copy paper from an electrophotographic copying machine, the unit comprising a drive roller and an idler roller, each having a plurality of longitudinally extending portions where the diameter of every other portion is larger than its adjacent portions, the rollers being disposed adjacent one another so that the larger portions of the drive roller are adjacent the smaller portions of the idler roller, and a plurality of rings disposed about the rollers to establish a substantially uniform clearance not greater than 1.5 mm. therebetween so that if any of the copy paper is ignited within the copying machine, the fire will be extinguished because of the clearance between the rollers, the copy paper being delivered from the copying machine with a predetermined rigidity along its direction of movement because of the disposition of the rollers with respect to one another to thereby lessen the tendency for the copy paper to turn over as it is delivered from the copying machine.

5 Claims, 2 Drawing Figures

COPY PAPER EXHAUSTING ROLLER UNIT FOR USE IN ELECTROPHOTOGRAPHIC COPYING MACHINE

BACKGROUND OF THE INVENTION

This idea relates to a copy paper exhausting roller unit used in an electrophotographic copying machine.

A schematic view of an ordinary copying machine is shown in FIG. 1 in which a toner image developed on a photoconductive drum "*a*" is transferred on a copy paper, which is transported by a gripper bar "*c*" in the direction shown by an arrow A into a thermal fuser "*d*" in which the image is thermally fixed by means of a heater "*e*". Then the copy paper is fed into a roller unit "*h*" through a pair of guide plates "*f*" and "*g*". The roller unit exhausts the paper sheet outside the machine in such manner that the sheet falls on receiving tray "*i*" keeping its front side up (without turning over). In order to avoid turning over of the sheet during the descent to the tray the sheet should be imparted with rigidity along its longitudinal direction, which is ordinarily accomplished by giving it a crease parallel to the moving direction of the sheet by passing the sheet between the roller unit. However, in electrophotographic copier employing either dry or wet development it is not preferred to bring the surface of the copy paper carrying toner image into contact with the surface of a roller since such contact deteriorates the image quality. Thus, it is not desirable to use in such casting roller unit a pair of rollers which contact the engage with each other the entire lengths thereof.

One may resort to another conveying method in which the copy paper, after receiving toner image and passing through the thermal fixer, is delivered by a conveyer belt to the tray. In this method, however, accidental brief interruption of electric power supply during the passage of the copy sheet through the fixer, will cause a fire accident; the sheet begins to burn by the stored heat in the fixer, then with the input of the power supply, the burning sheet is delivered outside the copier to cause a fire to spread in the room in which the copier is placed.

This idea has been made in consideration of this background and its principal object is to disclose a new copy paper exhausting roller unit which imparts the copy sheet suitable rigidity along its moving direction by giving creases without coming into contact with the entire surface of the sheet and which can also extinguish the fire of a burning sheet before delivering outside the machine.

DESCRIPTION OF A PREFERRED EMBODIMENT

Now a practical embodiment of the present idea will be described referring to the accompanying FIG. 2.

Figure 1:
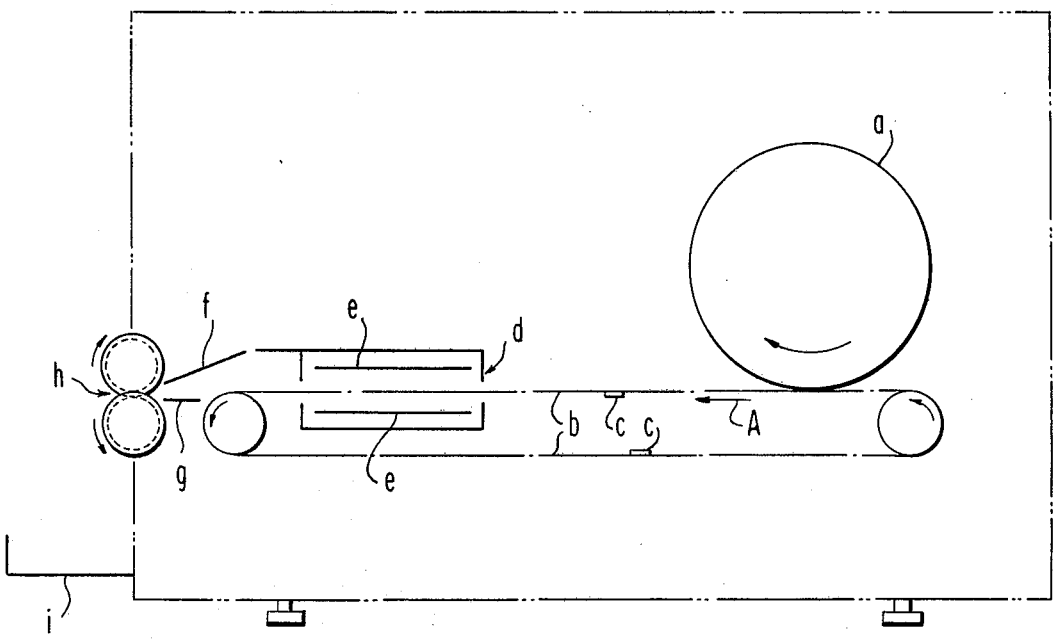
FIG. 1 is a schematic view of an ordinary copying machine.
Figure 2:
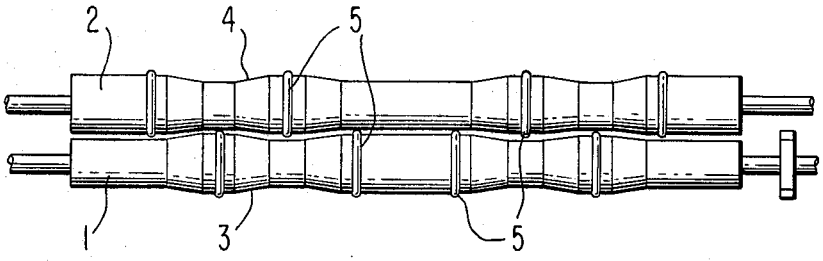
FIG. 2 is a front view of roller unit as one embodiment of the present invention, in which 1 is a drive and 2 an idler roller, respectively.

FIG. 2 is a side view of a roller unit constructed in accordance with the present invention and the unit comprises a drive roller 1 and an idler roller 2 each of which has a thick (belly) and thin (neck) portions. The inclined side face of the trucated cone connecting the belly and the neck works, together with the side face of the facing cone of the other roller, to form a crease in the paper sheet (3 and 4 in the Figure). At every vortex of the thick portion of each roller is fitted on O-shaped ring 5 in order to prevent direct contact of the two rollers. The clearance between the rollers is determined by the thickness of the O-ring. One may think that a smaller clearance is preferable with respect to the fire extinguishing capability of the roller unit; however, our experiment has proved that a blazing sheet can be effectively appeased by the passage through a relatively wide clearance of the roller unit, that, on the contrary, a narrow clearance is necessary for a smouldering sheet, and that in any case the optimum value of the clearance is deeply related with the transporting velocity of the sheet. Moreover it has been proved that a clearance larger than 1.5 mm has no fire extinguishing capability. The experiment was carried out with a clearance of 0.1–0.8 mm which value was determined in relation with the thickness of the paper used and thus should not be taken as limitative on the scope of the present idea. The material used for the rollers was a heat-resistant plastic, which proved to have a satisfactory extinguishing property. If metallic rollers or whose with large heat conductance are employed for the drive and idler rollers 1 and 2, a higher extinguishing capability is expected since such rollers will lower the temprature of a smoking sheet below the combustion point of paper.

The copy paper exhausting roller unit of the present idea is constructed as has been described above, and thus it can impart the copy sheet a suitable rigidity along its moving direction by giving creases without coming into contact with the entire surface of the sheet and at the same time can appease an accidentially burning sheet before delivering outside the machine to prevent the spreading of the fire.

What we claim is:

1. A roller unit for removing copy paper from an electrophotographic copying machine, said unit comprsing a drive roller and an idler roller, each having a plurality of longitudinally extending portions where the diameter of every other portion is larger than its adjacent portions, said rollers being disposed adjacent one another so that the larger portions of said drive roller are adjacent the smaller portions of said idler roller, and a plurality of rings disposed about said rollers to establish a substantially uniform clearance not greater than 1.5 mm. therebetween so that if any of said copy paper is ignited within said copying machine, the fire will be extinguished because of the clearance between said rollers, said copy paper being delivered from said copying machine with a predetermined rigidity along its direction of movement because of the said disposition of said rollers with respect to one another to thereby lessen the tendency for said copy paper to turn over as it is delivered from said copying machine.

2. A roller unit as in claim 1 where said clearance is 0.1–0.8 mm.

3. A roller unit as in claim 1 where said rings are disposed about the larger portions of each roller.

4. A roller unit as in claim 1 where each of said rollers is metallic so that the heat conductance thereof is such as to rapidly extinguish copy paper which may be on fire.

5. A roller unit as in claim 2 where each larger diameter portion of said drive and idler rollers is connected to its adjacent portions by truncated conical members to thereby effect said substantially uniform clearance between said drive and idler rollers.

* * * * *